US007770639B1

(12) United States Patent
Pledger

(10) Patent No.: US 7,770,639 B1
(45) Date of Patent: Aug. 10, 2010

(54) METHOD FOR PLACING DOWNHOLE TOOLS IN A WELLBORE

(76) Inventor: Teddy M. Pledger, 1608 W. Gulfport St., Broken Arrow, OK (US) 74011

( * ) Notice: Subject to any disclaimer, the term of this patent is extended or adjusted under 35 U.S.C. 154(b) by 353 days.

(21) Appl. No.: 11/967,406

(22) Filed: Dec. 31, 2007

(51) Int. Cl.
*E21B 47/09* (2006.01)

(52) U.S. Cl. ..... 166/255.1; 166/254.1; 73/152.54

(58) Field of Classification Search ..... 166/254.1, 166/254.2, 255.1; 73/152.54
See application file for complete search history.

(56) References Cited

U.S. PATENT DOCUMENTS

| | | | | |
|---|---|---|---|---|
| 3,145,771 | A | 8/1964 | Pennebaker | |
| 3,291,207 | A | 12/1966 | Rike | |
| 3,396,786 | A | 8/1968 | Schuster | |
| 3,396,787 | A | 8/1968 | Vann | |
| 3,396,788 | A * | 8/1968 | Bell | 166/255.1 |
| 3,497,958 | A | 3/1970 | Gollwitzer | |
| 4,327,412 | A | 4/1982 | Timmons | |
| 5,279,366 | A | 1/1994 | Scholes | |
| 6,516,663 | B2 | 2/2003 | Wong | |
| 6,736,210 | B2 | 5/2004 | Hosie | |
| 7,073,582 | B2 | 7/2006 | Connell | |
| 2004/0221986 | A1 | 11/2004 | Hosie | |
| 2005/0199392 | A1 | 9/2005 | Connell | |

OTHER PUBLICATIONS http://dictionary.reference.com/browse/threshold.*
Wireline Operations and Procedures, Third Edition (American Petroleum Institute, Washington, DC, 1994).
Introduction to Oil and Gas Production, Fifth Edition (American Petroleum Institute, Washington, DC, Jun. 1996).

* cited by examiner

*Primary Examiner*—Jennifer H Gay
*Assistant Examiner*—Sean D Andrish
(74) *Attorney, Agent, or Firm*—McAfee & Taft

(57) ABSTRACT

Downhole tools attached to a wireline are frequently used to perform well operations at a selected depth. However, the downhole tools may be placed at the incorrect depth if the well operator fails to account for creep, i.e. the movement of downhole tools after the wireline is stopped at the surface. This invention provides a method for determining when the well operator should account for creep. The invention further provides methods for determining the magnitude of creep when it is determined to be present. The subsequent positioning of downhole tools may be adjusted according to the magnitude of creep, thus preventing incorrect placement of downhole tools within the wellbore. The methods use equipment and logging data that are readily available during any wireline operation.

16 Claims, 4 Drawing Sheets

METHOD FOR PLACING DOWNHOLE TOOLS IN A WELLBORE

BACKGROUND OF THE INVENTION

1. Field of the Invention

The present invention generally relates to the field of well drilling operations, and more specifically to methods and systems for positioning downhole tools in a wellbore. In particular, the present invention discloses a method for more accurately adjusting the position of downhole tools by accounting for additional tool movement that occurs within the wellbore as a result of various external factors.

2. Description of the Problem and Related Art

A well is formed by drilling a borehole into the earth to recover fluids, such as hydrocarbons, natural gas, or water. The borehole may be lined with a casing that is held in place by surrounding cement along the borehole to form a wellbore. The well may be classified as a vertical, deviated, or horizontal well. Vertical wells are drilled toward a target that is generally beneath the surface location of the drilling equipment. Deviated wells are wells that are drilled into the earth's surface at an angle. Horizontal wells extend from a vertical or deviated well and are parallel to the earth's surface.

After the borehole has been drilled but before the casing is set, measurements may be taken along the length of the borehole by running sensing and recording instruments through the open hole to produce an open hole log that correlates readings of various subterranean formations with the depth at which the measurements were made. This open hole log generally takes the form of a graph of measurements taken by the particular instrument along one axis and the depth within the well along an orthogonal axis. These measurements, or readings, are typically characteristics of the subsurface formation, such as natural gamma ray radiation, resistivity, and porosity. Based on these readings, a well operator is able to identify and locate zones of interest that may potentially produce desirable fluids, such as hydrocarbons.

If the well operator identifies one or more zones of interest, the open hole is cased to provide a wellbore. Casing generally consists of a string of steel pipes that are connected by casing collars and lowered down the borehole and held in place by a surrounding layer of cement between the casing and the borehole. Casing may also be made of other materials, such as fiberglass or polypropylene, and connected without the use of collars. This wellbore structure prevents the walls of the borehole from collapsing and allows sections of the wellbore to be isolated from other sections.

After the wellbore is complete, a second log is typically run within the wellbore to correlate selected locations along the casing with the zones of interest identified in the open hole log. Casing devices, i.e. markers attached to or incorporated into the casing, may be identified and located in this manner. Casing collars that are used to connect two sections of pipe are frequently used as markers. Other types of casing devices may be used, such as magnetic devices, radioactive devices, and radiofrequency devices.

After the casing has been inserted and cemented within the borehole, there are a number of operations that can be performed in order to complete the well. Different downhole tools may be used to perform these operations, depending upon the desired result. For example, a perforating gun may be used to punch holes in the casing and cement so that fluid can flow from the subsurface formation into the well and be brought to the surface. As another example, bridge plugs, packers, and cement retainers can be used to isolate a zone of interest from other zones within the well. Occasionally a decision may be made to create a borehole laterally from the main wellbore, which requires the insertion of a whipstock at a given depth within the wellbore so that a drill bit is urged to penetrate the casing at that depth. Downhole tools must be placed at the correct location in order to perform their function and achieve the desired result.

Downhole tools are inserted into the wellbore on a high strength steel cable, or wireline, which is controlled by surface equipment. The surface equipment controlling the movement of the wireline generally includes a power source; a hydraulic drive unit (or a transmission on some of the older units); a spool or other storage device around which the wireline is coiled, which is actuated and controlled by the hydraulic drive; a measurement mechanism in contact with the wireline between the spool and the wellhead to measure the length of the deployed wireline; and an odometer that records the length of the wireline fed into the wellbore. One or more downhole tools may be attached to the wireline as a tool string. The tool string generally includes a detector that can accurately locate the casing devices so that downhole tools can be positioned at a selected depth. The detector transmits signals to an indicator, which is generally part of the surface equipment.

Generally, the tool string is lowered to a depth below the depth where the downhole tools are ultimately to be positioned. The tool string is then raised at a rate of speed recommended for the type of detector so that the wireline is in tension. As an alternative, the detector may be used to locate the casing devices as the downhole tools are lowered into the wellbore. The odometer of the surface equipment is then calibrated to correspond to the locations of the casing devices as recorded in the correlation log.

Regardless of whether the downhole tools are raised or lowered to the correct depth, the surface equipment is stopped when the selected casing device within the wellbore is located. When the surface equipment is stopped, however, the downhole tools do not immediately stop moving. The movement of the downhole tools after the surface equipment has stopped is frequently called "creep." Some of the factors that may influence the amount of creep include wireline speed, the weight of the downhole tools, depth, wireline size, wellbore deviations, the outer diameter of downhole tools relative to the inner diameter of the casing, and the viscosity of fluid in the casing. Unless creep is accurately determined and the position of downhole tools adjusted accordingly, the downhole tools will not be in the correct position to accomplish the desired result.

Failure to account for creep may result in downhole operations being performed at the incorrect depth or being performed multiple times before the correct depth is reached. Perforations or downhole equipment such as bridge plugs, packers, and cement retainers may be set at the incorrect depth, resulting in excessive gas or water production. Even worse, when the zones of interest are relatively thin, failure to account for creep could result in perforations that are above or below the zone, making a potentially productive well appear to be a "dry hole." The well would then be plugged and abandoned due to lack of production, resulting in the loss of potential revenue from production as well as the money invested to investigate the site, obtain the mineral rights, and drill and complete the well. In addition, the entire subsurface field may be abandoned for lack of production, further compounding the economic loss.

Others have considered methods for placing downhole tools at a selected depth within a wellbore, and for background information relating to such placement, reference may be made to the following United States patents and patent publications:

| U.S. Pat. No. | Title | Inventor |
|---|---|---|
| 3,145,771 | Well Operation Depth Control Method | Pennebaker |
| 3,291,207 | Well Completion Method | Rike |
| 3,396,786 | Depth Control Methods and Apparatus | Schuster et al. |
| 3,396,787 | Depth Control Methods and Apparatus | Vann |
| 3,396,788 | Depth Control Methods and Apparatus | Bell |
| 3,497,958 | Systems and Methods for Determining the Position of a Tool in a Borehole | Gollwitzer |
| 4,327,412 | Well Logging Data Processing Technique | Timmons |
| 5,279,366 | Method for Wireline Operation Depth Control in Cased Wells | Scholes |
| 6,516,663 B2 | Downhole Electromagnetic Logging into Place Tool | Wong |
| 6,736,210 B2 | Apparatus and Methods for Placing Downhole Tools in a Wellbore | Hosie et al. |
| 7,073,582 B2 | Method and Apparatus for Positioning a Downhole Tool | Connell et al. |

| Pub. No. | Title | Inventor |
|---|---|---|
| 2004/0221986 A1 | Apparatus and Methods for Placing Downhole Tools in a Wellbore | Hosie et al. |
| 2005/0199392 A1 | Method and Apparatus for Positioning a Downhole Tool | Connell et al. |

For example, U.S. Pat. No. 3,396,787, to Vann, discloses a method and apparatus for accurately positioning a well tool in a wellbore by adjusting pre-existing settings obtained from well logs, according to casing collar depths as the casing collars are detected by the well tool during descent or ascent. The disclosure acknowledges that slight errors will occur as the cable is being unreeled, but does not provide a method for adjusting for these errors before the casing collar depths are determined nor does it address the problem of creep after the cable is stopped.

U.S. Pat. No. 3,497,958, to Gollwitzer, discloses a method and system for accounting for cable stretch, which measure the difference in tension between the cable end at the tool and the cable end at the surface of the earth, and then corrects the cable length measurements derived from the sheave wheel device according to the tension difference. The disclosure goes on to correct for sheave wheel calibration errors and temperature effects on the cable stretch, but does not take into account other factors, e.g. viscosity of the fluid through which the downhole tool is immersed, angle of the wellbore, etc., nor does it address the problem of creep after the cable is stopped.

U.S. Pat. No. 4,327,412, to Timmons, discloses a method of correlating the results of two or more well logs in order to compensate for errors in measurements. The disclosure acknowledges that cable length measurement devices, i.e. sheave-wheel devices, do not accurately take errors caused by cable stretch into account. It goes on to describe a statistical method to compensate for such errors by comparing two or more well logs recorded by different recording devices or by successive runs of the same recording device in order to account for erroneous depth displacements. However, the method does not provide a method, once the corrective displacement is known, of accurately positioning a tool or recording device within a wellbore to account for creep nor does it address the problem of creep after the cable is stopped.

U.S. Pat. No. 6,736,210, to Hosie et al., discloses the use of a collar detector to communicate a depth position of an apparatus in a wellbore to the surface of the well. U.S. Pat. Pub. No. 2004/0221986, to Hosie et al., also discloses the use of a collar detector to communicate a depth position of an apparatus in a wellbore to the surface of the well. However, the method does not specifically address the problem of tool movement within the wellbore after the surface equipment is stopped.

None of these references specifically accounts for the problem of creep after the surface equipment has stopped. As a result, use of these methods does not take into consideration the movement of the tool resulting from creep, once the tool has been placed within the wellbore. This incorrect placement may result in operational delays, additional costs, and even the abandonment of potentially productive wells or fields.

SUMMARY OF THE INVENTION

A method is provided for determining the necessity to consider the magnitude of creep, the method comprising the steps of creating a first casing device log as a tool string is moved in one direction through a zone of interest within a wellbore; creating a second casing device log as the tool string is moved in the opposite direction through the zone of interest; comparing the locations of corresponding casing devices on each log; and determining that creep must be considered if the locations differ by more than a threshold amount.

A method is also provided for determining the magnitude of creep, where the method comprises the steps of configuring a tool string; selecting a first casing device; initializing a total increment to zero; repeatedly increasing the value of the total increment by an increment, raising the tool string to a depth that is greater than the depth of the first casing device by the value of the total increment, stopping the wireline, and monitoring the indicator for the detection of a casing device; and determining the amount of creep.

A method is further provided for determining the magnitude of creep, where the method comprises the steps of configuring the tool string; selecting a zone of interest and a casing device immediately above the zone; initializing a total increment to zero; repeatedly increasing the value of the total increment by an increment, lowering the tool string to a depth that is less than the depth of the selected casing device by an amount given by the total increment, stopping the wireline, monitoring the indicator for the detection of the casing device, and confirming the depth of the tool string; and determining the amount of creep.

These and other features, aspects, and advantages of the present invention will become better understood with reference to the following drawings, description, and claims.

BRIEF DESCRIPTION OF THE DRAWINGS

So that the manner in which the above recited features, advantages, and objects of the invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The invention may provide a method for adjusting the position of a downhole tool to account for the movement of the tool that occurs within the wellbore after the surface equipment controlling tool depth is stopped. The invention may allow the downhole tool to be accurately positioned at a desired depth, as determined by an analysis of well logs. This invention may find application in any area which involves the use of a long wireline from which is suspended a tool or measurement device, in an area where the tool or measurement device is inaccessible for inspection. Although the invention is described in the context of well drilling and completion operations, it may also find application in other unrelated areas such as deep sea exploration, underwater cable installations, and wells drilled in exploration for other raw materials such as water or natural gas.

The invention provides a method for the accurate placement of tools at a selected depth within a wellbore. It uses existing equipment and logging data that are readily available during any wireline operation, such as casing devices, detectors, odometers, the wireline or cable, and winching equipment used to raise and lower the wireline. The invention is equally applicable to lowering downhole tools within the wellbore, raising downhole tools from the wellbore, or horizontal drilling methods using a locomotive. In addition, the invention may be applied to any type of wellbore, including those for water or oil and gas production. The invention may be used in any operation where the surface equipment is stopped to allow the downhole tools to perform their function within a wellbore.

It should be understood that the present invention may be applicable to any operation involving the accurate positioning of a downhole tool on a wireline within a wellbore. Because creep may vary because of many factors, including the weight of the downhole tools and depth, the invention may be advantageously used for each different wireline operation, including multiple operations performed with the same tool string within the wellbore. Moreover, it should be understood that any one or more means can be used to determine the relation of particular earth formations to each other as well as to some identifiable point within the wellbore.

Figure 1:
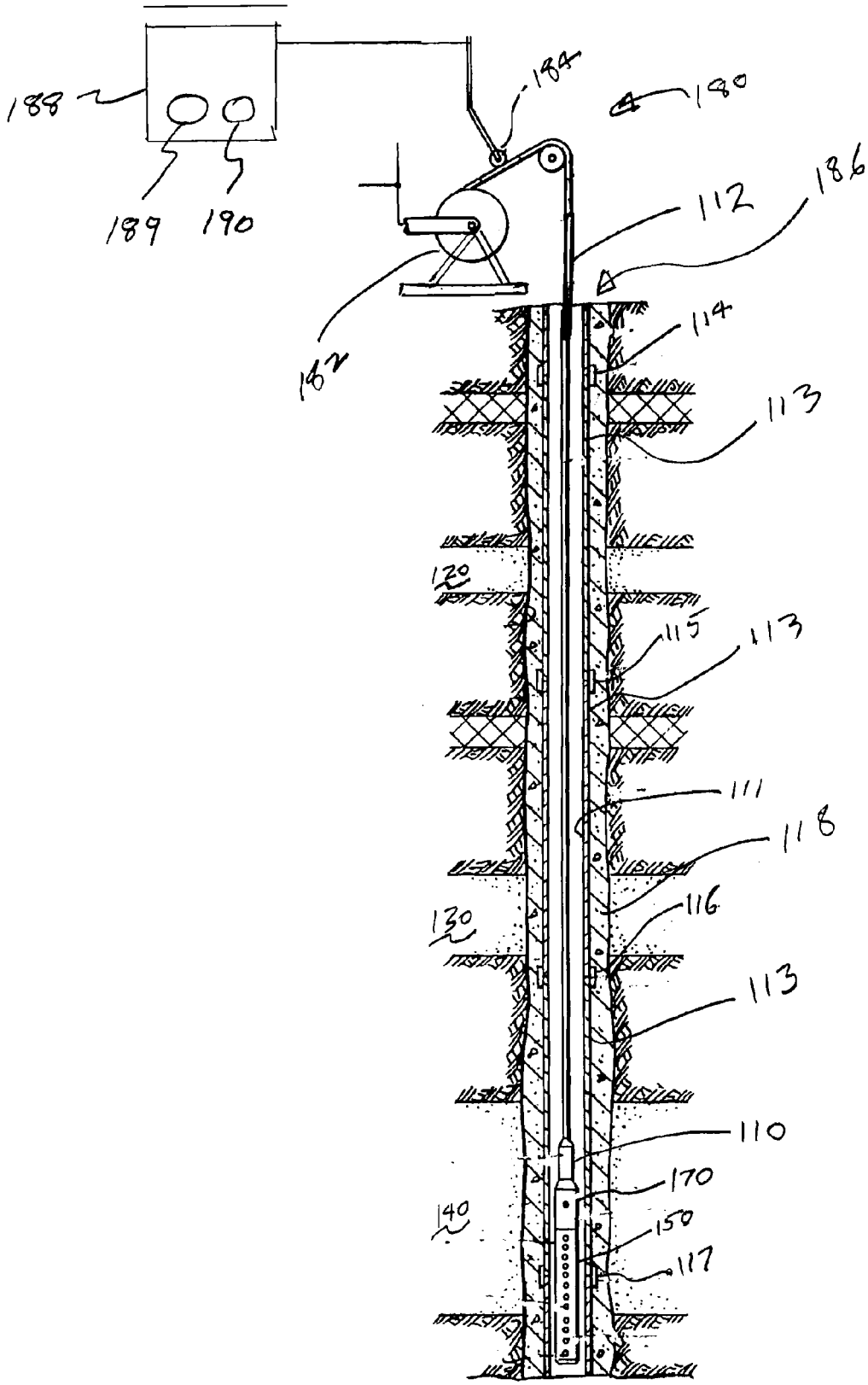
FIG. 1 shows a typical wellbore including surface equipment and downhole tools, according to an embodiment of the invention.

Referring now to FIG. 1, a typical tool string 110 may be shown suspended in a wellbore 111 from a wireline 112. As is customary, the wellbore 111 may be completed by a string of casing sections 113 connected to one another and secured in place in the wellbore by cement 118. Casing devices, i.e. markers attached to or incorporated into the casing, as at 114-117, may be spaced at selected intervals along the length of the wellbore 111. As one embodiment of the present invention, however, it is assumed that the tool string 110 may be used to make a selected number of perforations (not shown) in several zones of interest 120-140. To accomplish this, the tool string 110 may be appropriately arranged to include a perforator 150 having thereon a number of perforating devices as, for example, a plurality of shaped charges (not shown) that may be selectively detonated as required. Inasmuch as the particular arrangement of the perforator 150 may play no part in the present invention, it is necessary only to understand that the perforator 150 may be suitably arranged so a predetermined number of one or more of its shaped charges (not shown) may be detonated upon command from the surface. To assist in positioning the perforator 150 at the correct depth, a depth-correlating means, such as a detector 170 for casing devices, may be mounted on the tool string 110. It should be understood that any detecting means that can detect an identifiable formation characteristic such as, for example, the natural or induced radioactivity of earth formations can also be used in the place of or in conjunction with the detector 170.

Surface equipment 180 controlling the movement of the wireline 112 may be located at the wellhead 186 of the wellbore 111. The surface equipment 180 generally includes a spool 182 or other storage device around which the wireline 112 may be coiled for deployment within the wellbore 111. A power source (not shown) may provide the motive force for moving the wireline 112 up and down the wellbore 111. In order to measure the amount of wireline 112 in the wellbore 111 and the speed at which the wireline 112 is deployed, a measurement mechanism 184 may be placed in contact with the wireline 112 between the spool 182 and the wellhead 186. The output of the measurement mechanism 184 may be sent to a computer or other instrument 188 for recording and processing. An odometer 189 may be associated with the measurement mechanism 184 to record the length of the wireline 112 that is fed into the wellbore 111, and thereby determine the depth of the tool string 110 beneath the surface. Frequently, the odometer 189 may be used to select a predetermined depth for the tool string 110, i.e. a length of the wireline 112 is to be dispensed from the spool 182. The surface equipment 180 may also include an indicator 190 that receives signals from the detector 170.

Figure 2:
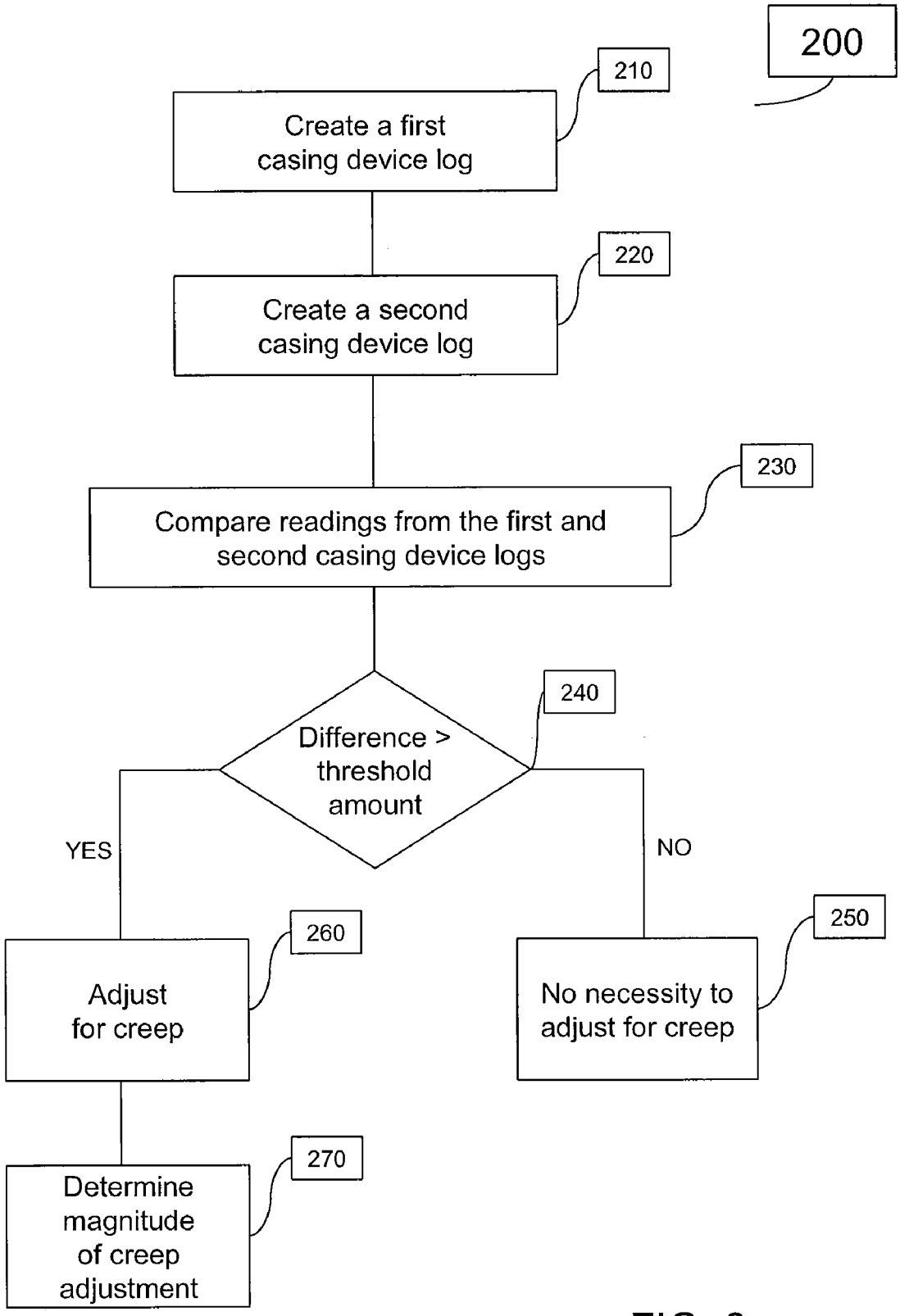
FIG. 2 shows a flowchart of the method for determining the necessity to consider the magnitude of creep, according to an embodiment of the invention.

Referring now to FIGS. 1 and 2, a flowchart 200 may be shown, illustrating a method for determining the necessity to consider the magnitude of creep for a well operation. A first casing device log may be produced, according to the block labeled 210. This may typically be done by setting an odometer 189 to record values for depth, configuring the tool string 110 with a detector 170, and causing the detector 170 to traverse the wellbore 111. The traversal may either be in a descending mode or an ascending mode. When nearing a zone of interest 130 according to the odometer 189, the speed of the wireline 112 may be adjusted to the recommended speed to maximize the accuracy of the detector 170. The locations of the casing devices 114-117 may be recorded as needed to create a first casing device log. The surface equipment 180 may then be stopped when the tool string 110 and detector 170 have moved past the zone of interest 130.

A second casing device log may then be created, where the second casing device log may be measured in a direction opposite from the direction used for the first casing device log, according to the block labeled 220. Without adjusting the odometer 189, the surface equipment 180 may be reversed to move the tool string 110 and detector 170 in the opposite direction at the same speed that was used to generate the first casing device log. The locations of the casing devices 114-117 may then be recorded as the tool string 110 and detector 170 pass the zone of interest 130 to create the second casing device log.

The first and second casing device logs may then be compared, according to the block labeled 230. More specifically, the well operator may compare the locations of each casing device 114-117 on the first and second casing device logs. A determination may then be made as to whether or not creep is present and must be accounted for, according to the block labeled 240. If the locations of the casing devices 114-117 do not differ by more than a threshold amount, then the well operator may not need to adjust the position of the tool string 110 to account for creep, according to the block labeled 250. A typical threshold amount may be about two feet (0.6 meter). Otherwise, the well operator may need to adjust for creep, according to the block labeled 260, and determine the magnitude of the creep adjustment, according to the block labeled 270.

Figure 3:
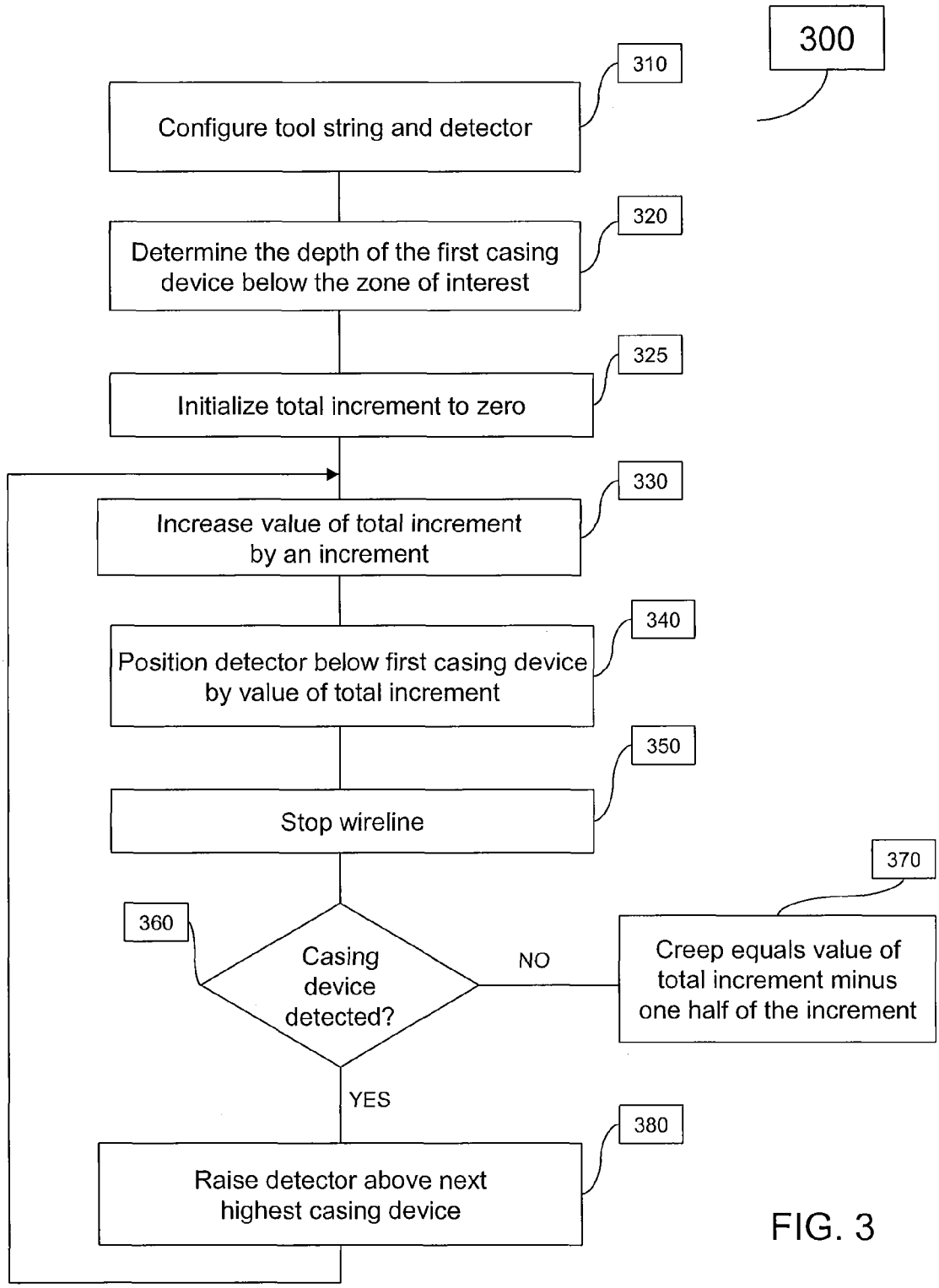
FIG. 3 shows a flowchart of the method for determining the magnitude of creep, according to an embodiment of the invention.

Referring now to FIGS. 1 and 3, a flowchart 300 may be shown to illustrate a method for determining the magnitude of creep for a well operation. The selection of downhole tools may be made, according to the block labeled 310. The tool string 110 may comprise one or more downhole tools (e.g. a perforator 150) and a detector 170. The tool string 110 and detector 170 may be configured so that depths are measured based on the location of the detector 170 rather than the location of the other downhole tools on the tool string 110. The detector 170 may also be configured so that the indicator 190 may display and record data from the detector 170 when the surface equipment 180 is stopped. For example, the indicator 190 may be a computer 188, in which case the computer 188 may be placed in time-drive mode. The time-drive mode may enable the indicator 190 to display and record data from the detector 170 even though the wireline 112 is stopped.

The well operator may determine the depth of the casing device 116 immediately below the zone of interest 130, according to the block labeled 320. The well operator may initialize a total increment to zero, according to the block labeled 325. The wireline 112 with the tool string 110 may then be lowered into the wellbore 111 and moved downwardly past the zone of interest 130. When nearing a zone of interest 130, the speed of the wireline 112 may be adjusted to a recommended wireline speed for the detector 170. This recommended speed should preferably be used consistently for all subsequent creep determinations.

The value of the total increment may be increased by an increment, according to the block labeled 330. A typical increment value may be about one foot (0.3 meter), but the well operator may use a different increment value, depending on factors such as the well characteristics and the type of well operation to be performed, without departing from the scope of the invention. The tool string 110 and the detector 170 may be raised in the wellbore 111 at a speed that is recommended for the detector 170 to a depth that is below the casing device 116 closest to the zone of interest 130 by the value of the total increment, according to the block labeled 340. The wireline 112 may then be stopped for a period of time, generally between 30 seconds and 60 seconds, according to the block labeled 350. Due to the phenomenon of creep, the tool string 110 and the detector 170 may continue to move during the period of time after the wireline 112 has been stopped at the surface.

If the casing device 116 is not detected (block 360), then the well operator may determine creep as the value of the total increment minus one half of the increment value, according to the block labeled 370. If the casing device 116 is detected, however, then creep may have caused the wireline 112 to shorten, thus pulling the detector 170 up past the casing device 116.

If the casing device 116 is detected (block 360), the tool string 110 and the detector 170 may be raised above the next highest casing device 115 to confirm the depth of tool placement, according to the block labeled 380. The process may be repeated, according to the blocks labeled 330-380, until the indicator 190 receiving readings from the detector 170 does not record the presence of the casing device 116. The well operator may then determine creep as the value of the total increment minus one half of the increment, according to the block labeled 370. The subsequent positioning of downhole tools may then be adjusted by this amount to account for creep.

Figure 4:
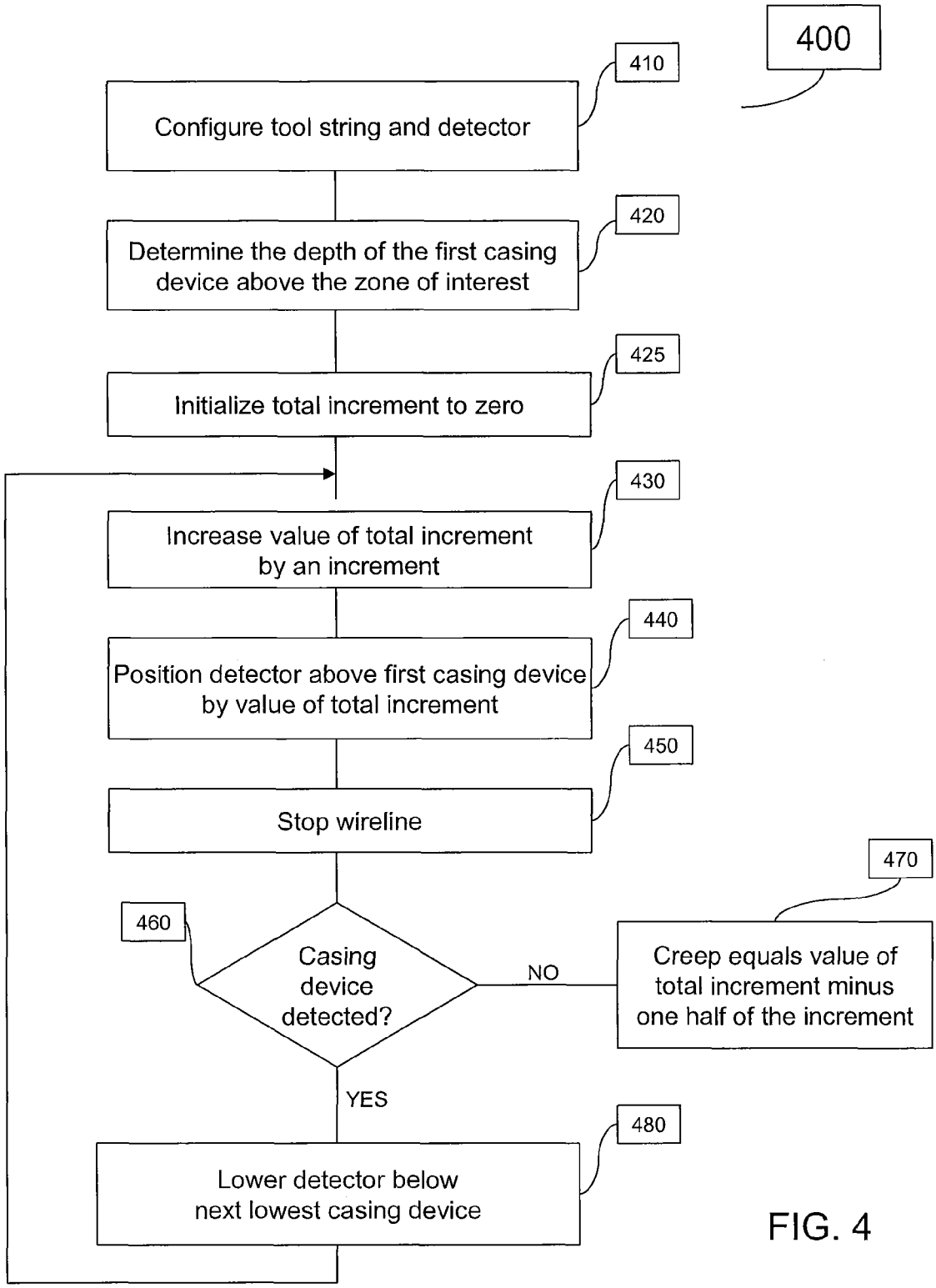
FIG. 4 shows a flowchart of another method for determining the magnitude of creep, according to an embodiment of the invention.

Referring now to FIGS. 1 and 4, a flowchart 400 may be shown to illustrate another embodiment of a method for determining the magnitude of creep for a well operation. The selection of downhole tools may be made for assembly into a tool string 110, according to the block labeled 410. The tool string 110 may comprise one or more downhole tools (e.g. a perforator 150) and a detector 170. The tool string 110 and detector 170 may be configured so that depths are measured based on the location of the detector 170 rather than the location of the other downhole tools on the tool string 110. The detector 170 may also be configured so that the indicator 190 may display and record data from the detector 170 when the wireline 112 is stopped at the surface. For example, the indicator 190 may be a computer 188, in which case the computer 188 may be placed in time-drive mode. The time-drive mode may enable the indicator 190 to display and record data transmitted by the detector 170 while the wireline 112 is stopped.

The well operator may determine the depth of the casing device 115 immediately above a zone of interest 130, according to the block labeled 420. The well operator may initialize a total increment to a value of zero, according to the block labeled 425. The wireline 112 with its tool string 110 may then be introduced into the wellbore 111 and moved downwardly. When nearing the zone of interest 130, the speed of the wireline 112 may be adjusted to a recommended wireline speed for the detector 170. The recommended speed should preferably be used consistently for all subsequent creep determinations.

The value of the total increment may be increased by an increment, according to the block labeled 430. A typical increment may be one foot (0.3 meter), but other increment values may be used, depending on well characteristics, the type of operation to be performed, and other factors, without departing from the scope of the invention. The tool string 110 and the detector 170 may be lowered into the wellbore 111 at a speed that is recommended for the detector 170 to a depth that is above the casing device 115 closest to the zone of interest 130 by the value of the total increment, according to the block labeled 440. The wireline 112 may then be stopped for a period of time, generally between 30 seconds and 60 seconds, according to the block labeled 450. Due to the phenomenon of creep, the tool string 110 and the detector 170 may continue to move during the period of time after the movement of the wireline 112 has been stopped at the surface.

If the casing device 115 is not detected (block 460) during the period of time, then the well operator may determine creep as the value of the total increment minus one half of the increment, according to the block labeled 470. If the casing device 115 is detected, however, then creep may have caused the wireline 112 to lengthen, thus pulling the detector 170 down past the casing device 115.

If the casing device 115 is detected (block 460), the tool string 110 and the detector 170 may be lowered below the next lowest casing device 116 to confirm the depth of tool placement, according to the block labeled 480. The process may be repeated, according to the blocks labeled 430-480, until the indicator 190 attached to the detector 170 does not record the presence of the casing device 115. The well operator may then determine creep as the value of the total increment minus one half of the increment, according to the block labeled 470. The subsequent positioning of downhole tools may then be adjusted by this amount to account for creep.

For example, if the creep in a wellbore is estimated to be 10 feet (3 meters) and the desired tool placement is 10,000 feet (3,048 meters) below ground surface, the downhole tools may be lowered below the desired depth and then raised until the downhole tools are located at 10,010 feet (3,051 meters) below ground surface. At this point, the wireline may be stopped and, due to creep, the downhole tools would continue to move upward for approximately 10 feet (3 meters), ultimately positioning them at the desired location. As an alternative, the downhole tools may be lowered to a depth of 9,990 feet (3,045 meters). The wireline may then be stopped, and creep would cause the downhole tools to descend for an additional 10 feet (3 meters) to the desired location.

It should be understood, of course, that the foregoing relates to exemplary embodiments of the invention and that modifications may be made without departing from the spirit and scope of the invention as set forth in the following claims. From the foregoing, it will be understood by persons skilled in the art that an inventive method of determining the magnitude of creep and an inventive method for determining the necessity to consider the magnitude of creep have been provided. This invention uses equipment and logging data that are readily available during any wireline operation, and may increase operating efficiency, maximize well productivity, and reduce unnecessary costs.

While the description contains many specifics, these should not be construed as limitations on the scope of the invention, but rather as an exemplification of the preferred embodiments thereof. The foregoing is considered as illustrative only of the principles of the invention. Further, because numerous modifications and changes will readily occur to those skilled in the art, it is not desired to limit the invention to the exact operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of the method may be resorted to without departing from the spirit and scope of the invention.

I claim:

1. A method for determining the magnitude of creep for a well operation performed by a wireline supporting a tool string in a wellbore with one or more casing devices situated along the wellbore, the wireline controlled by surface equipment having an indicator, the method comprising the steps of:

configuring the tool string for the well operation;

selecting a first casing device having a first casing device depth; initializing a total increment to zero;

performing the following steps until the first casing device is not detected:

increasing the value of the total increment by an increment; moving the tool string within the wellbore at a selected speed to a greater depth than the first casing device depth;

raising the tool string at the selected speed to a test depth that is greater than the first casing device depth by the value of the total increment;

stopping the wireline at the test depth for a selected time duration; and monitoring the indicator for detection of the first casing device during the selected time duration; and determining an amount of creep as being equal to the value of the total increment minus one half of the increment.

2. The method described in claim 1, further comprising the steps of selecting a zone of interest, wherein the first casing device has the first casing device depth greater than a depth of a zone of interest, and no casing devices are situated between the zone of interest and the first casing device.

3. The method described in claim 1, further comprising the steps of raising the tool string above a second casing device having a second casing device depth in order to re-confirm the depth of the tool string.

4. The method described in claim 1, wherein the increment is one foot (0.3 meter).

5. The method described in claim 1, wherein the tool string comprises a detector.

6. The method described in claim 5, wherein the tool string further comprises a downhole tool that is used in the well operation.

7. The method described in claim 5, wherein the indicator is a computer receiving a signal from the detector.

8. A method described in claim 7, wherein the computer operates in time-drive mode.

9. The method described in claim 1, wherein the selected speed is a speed recommended to maximize accuracy of the detector.

10. The method described in claim 1, wherein the selected time duration is a value in a range of from about 30 seconds to about 60 seconds.

11. A method for determining the magnitude of creep for a well operation performed by a wireline supporting a tool string in a wellbore with one or more casing devices situated along the wellbore, each casing device being situated at a casing device depth, the wireline controlled by surface equipment, the method comprising the steps of:

configuring the tool string for the well operation;

selecting a zone of interest;

selecting an upper casing device having an upper casing device depth above the zone of interest, wherein no casing devices are situated between the zone of interest and the upper casing device;

initializing a total increment to zero;

performing the following steps until the upper casing device is not detected:

increasing the value of the total increment by an increment;

moving the tool string within the wellbore at a selected speed to a depth less than the upper casing device depth;

lowering the tool string at the selected speed to a first depth that is less than the upper casing device depth by the value of the total increment; stopping the wireline for a selected time duration;

determining the detection of the upper casing device; and lowering the tool sting below a next lowest casing device to confirm the depths of the tools if the upper casing device is detected; and determining an amount of creep as being equal to the value of the total increment minus one half of the increment.

12. The method described in claim 11, wherein the increment is one foot (0.3 meter).

13. The method described in claim 11, wherein the tool string comprises a detector.

14. The method described in claim 13, wherein the tool string further comprises a downhole tool that is used in the well operation.

15. The method described in claim 11, wherein the selected speed is a speed recommended to maximize accuracy of the detector.

16. The method described in claim 11, wherein the selected time duration is a value in a range of from about 30 seconds to about 60 seconds.

* * * * *